US010548398B2

(12) United States Patent
Butler

(10) Patent No.: US 10,548,398 B2
(45) Date of Patent: Feb. 4, 2020

(54) WHEELED KITCHEN APPARATUS WITH COLLAPSIBLE WORK SURFACE

(71) Applicant: EDIBLE EDUCATION LLC, Midlothian, VA (US)

(72) Inventor: Ann Louise Butler, Midlothian, VA (US)

(73) Assignee: EDIBLE EDUCATION LLC, Midlothian, VA (US)

( * ) Notice: Subject to any disclaimer, the term of this patent is extended or adjusted under 35 U.S.C. 154(b) by 0 days.

(21) Appl. No.: 15/598,422

(22) Filed: May 18, 2017

(65) Prior Publication Data

US 2018/0332961 A1 Nov. 22, 2018

(51) Int. Cl.

| | |
|---|---|
| ***A47B 77/02*** | (2006.01) |
| ***F24H 1/00*** | (2006.01) |
| ***A47B 31/02*** | (2006.01) |
| ***A47B 77/06*** | (2006.01) |
| ***A47B 77/08*** | (2006.01) |
| ***A47B 77/10*** | (2006.01) |

(52) U.S. Cl.

CPC ..... *A47B 77/022* (2013.01); *A47B 31/02* (2013.01); *A47B 77/06* (2013.01); *A47B 77/08* (2013.01); *A47B 77/10* (2013.01); *F24H 1/0018* (2013.01); *A47B 2220/03* (2013.01)

(58) Field of Classification Search

CPC ..... A47B 77/022; A47B 77/06; A47B 77/08; A47B 77/10; A47B 31/02; A47B 31/00; A47B 2220/03; A47B 1/00; A47B 1/04; F24H 1/0018; F24C 1/16

USPC ..... 312/140.2

See application file for complete search history.

(56) References Cited

U.S. PATENT DOCUMENTS 885,630 A * 4/1908 Mason
1,886,806 A * 11/1932 Hanley ..... A63F 1/06 108/86
2,043,797 A * 6/1936 Horn ..... F24C 7/00 108/78

(Continued)

OTHER PUBLICATIONS

International Search Report dated Jul. 24, 2018 issued in PCT/US2018/033171.

*Primary Examiner* — Daniel J Troy
*Assistant Examiner* — Timothy M Ayres
(74) *Attorney, Agent, or Firm* — Sughrue Mion, PLLC

(57) ABSTRACT

A wheeled kitchen apparatus with a collapsible work surface includes a wheeled cabinet with a cabinet top and four cabinet sides. The cabinet top has a surface with an opening accommodating a basin, and also has a heating unit. The cabinet has four extensions located at the four cabinet sides. The four extensions are configurable between at least two positions including a first position that laterally extends the surface of the top of the cabinet and a second position in which the extensions fold down along the sides of the cabinet. The unit can include running water, including hot and cold water, and can also include an oven. The collapsible work surface permits the apparatus to fit through classroom doors and therefore usable in every school environment. The shape of the extensions, when configured in the upward position, safely moves school-age children away from the potentially dangerous heating unit and other equipment that may pose harm if within reach of the children.

25 Claims, 7 Drawing Sheets

(56) References Cited

U.S. PATENT DOCUMENTS 2,309,513 A * 1/1943 Kramer ..... A47B 31/02 165/138
2,497,156 A * 2/1950 Davis ..... A47B 3/10 126/37 R
3,289,664 A * 12/1966 Hewitt ..... A47B 77/08 126/37 R
3,478,193 A * 11/1969 Molitor ..... A47B 31/02 126/268
3,672,741 A * 6/1972 Clark ..... A47B 49/00 312/140.2
3,748,437 A * 7/1973 Keeshin ..... A47B 31/02 126/268
3,915,529 A * 10/1975 Bernier ..... A47B 3/10 126/37 B
4,038,518 A * 7/1977 Morton ..... H05B 6/1209 219/218
4,332,992 A * 6/1982 Larsen ..... H05B 6/6435 126/21 A
4,480,164 A * 10/1984 Dills ..... H05B 6/6482 126/21 A
4,508,947 A * 4/1985 Eke ..... H05B 6/6411 126/21 A
4,974,500 A * 12/1990 Boyd ..... A47B 31/02 221/96
5,306,029 A 4/1994 Kaiser, II
5,730,066 A * 3/1998 Auten ..... B60N 3/001 108/44
5,862,540 A * 1/1999 Chuan ..... B60P 3/36 4/449
5,981,914 A * 11/1999 Schultheis ..... A47J 37/067 219/452.11
6,173,458 B1 1/2001 Maddux
6,349,715 B1 * 2/2002 McBroom ..... F24B 1/207 126/276
6,431,628 B1 * 8/2002 Bell, Jr. ..... B60P 3/0257 296/22
6,598,514 B2 * 7/2003 Leggi ..... A47F 9/00 126/276
6,814,383 B2 * 11/2004 Reed, III ..... B60P 3/0257 224/404
7,703,384 B2 * 4/2010 Annis ..... F24C 15/30 219/494
7,750,273 B2 * 7/2010 Herving ..... H05B 6/12 219/621
8,696,075 B1 * 4/2014 Rios ..... A47F 10/06 126/25 R
9,089,210 B2 * 7/2015 Kool ..... A47B 31/02
2003/0019031 A1 * 1/2003 Mosis ..... A47K 1/02 4/625
2007/0131221 A1 * 6/2007 Lightbourne ..... F24C 1/16 126/275 R
2007/0215011 A1 * 9/2007 Khan ..... A45C 9/00 108/11
2008/0185376 A1 * 8/2008 Gagas ..... H05B 6/1263 219/623
2010/0193507 A1 * 8/2010 Zimmer ..... H05B 6/6485 219/681
2010/0212344 A1 8/2010 Mattucci
2011/0185919 A1 * 8/2011 Yglesias ..... A47J 37/00 99/443 R
2012/0031910 A1 2/2012 Hogestyn
2013/0057133 A1 3/2013 Kool
2013/0160755 A1 6/2013 Pujol
2015/0330640 A1 11/2015 Wersborg
2016/0039326 A1 * 2/2016 Smith ..... F24C 15/2042 126/268

* cited by examiner

100

100

WHEELED KITCHEN APPARATUS WITH COLLAPSIBLE WORK SURFACE

FIELD

This disclosure relates to a wheeled kitchen apparatus useful in teaching food preparation and nutrition to children, among other purposes.

BACKGROUND

Studies from the Centers for Disease Control and Prevention (CDC) have reviewed the impact of cooking classes on food-related preferences, attitudes, and behaviors of school-aged children. See Hersch D, Perdue L, Ambroz T, Boucher JL. *The Impact of Cooking Classes on Food-Related Preferences, Attitudes, and Behaviors of School-Aged Children: A Systematic Review of the Evidence,* 2003-2014. Prev Chronic Dis 2014; 11:140267. The studies' findings suggest that cooking programs may positively influence children's food-related preferences, attitudes, and behaviors.

Delivering cooking classes to children, however, is difficult in most educational facilities. Schools often have kitchens, but these are suited to large scale food preparation by trained adults and are unsafe environments for children. Few schools have dedicated classroom facilities that permit delivery of hands-on cooking classes.

SUMMARY

An object of the discussion below is to disclose an apparatus suitable for providing hands-on food preparation classes to school-age children.

One example includes an apparatus having a wheeled cabinet with a cabinet top and four cabinet sides. The apparatus also includes the cabinet top having a surface with an opening accommodating a basin, and having a heating unit. The apparatus also includes four extensions disposed at the four cabinet sides, configurable in a first position to extend laterally away from the four cabinet sides, in a plane of the surface of the cabinet top.

In another example, the four extensions are further configurable to a second position, to extend in a direction perpendicular to the plane of the surface of the cabinet top.

In another example, the heating unit is fixed to the surface of the cabinet top.

In another example, the four extensions each have a respective proximal edge adjacent the cabinet top and one or more distal edges not, in the first position, adjacent the four cabinet sides. For improved safety, the four extensions have a particular shape that separates students from the heating unit by at least a minimum predetermined distance.

In another example, the wheeled cabinet has a base bottom with an exterior face exposed to the outside of the wheeled cabinet and an interior face opposite the exterior face, and an oven disposed between the cabinet top and the interior face of the base bottom.

In another example, the apparatus has an electrical power inlet receptacle mounted at least in part on an outer surface of the wheeled cabinet, and electrically connected with the oven.

In another example, the apparatus includes a first container within the wheeled cabinet, a first communication path communicating between the first container and a first orifice disposed above the cabinet top, and a flow control device controlling the communication to the first orifice.

In another example, the apparatus further includes: a second container within the wheeled cabinet, a second communication path communicating between the second container and a second orifice, and the second orifice disposed between the cabinet top and the interior face of the base bottom.

In an example, the apparatus has a pump operable in the first communication path to urge fluid toward the first orifice.

In another example, the apparatus has an electrical power inlet receptacle mounted at least in part on an outer surface of the wheeled cabinet, and electrically connected with the pump.

In another example, the apparatus includes a heater operable to heat fluid from the first container.

The subject matter below herein taught by way of various specific examples explained in detail, and illustrated in the enclosed drawing figures.

BRIEF DESCRIPTION OF THE DRAWINGS

The drawing figures depict, in highly simplified schematic form, examples reflecting the principles of the apparatus suitable for teaching school-age children to prepare food. Many items and details that will be readily understood by one familiar with this field have been omitted to avoid obscuring the key concepts. In the drawings.

TABLE 1

TABLE OF REFERENCE NUMBERS

| Number | Term |
|---|---|
| 100 | an apparatus |
| 110 | a wheeled cabinet |
| 120 | a cabinet top |
| 130 | four cabinet sides |
| 140 | a surface |
| 150 | a basin |
| 160 | a heating unit |
| 170 | four extensions |
| 175 | reconfigurable extension support hardware |
| 180 | a first position |
| 190 | a plane |
| 200 | a second position |
| 210 | a direction |
| 220 | a proximal edge |
| 230 | one or more distal edges |
| 240 | a predetermined distance |
| 250 | a base bottom |
| 260 | an exterior face |
| 270 | an interior face |
| 280 | an oven |
| 290 | an electrical power inlet receptacle |
| 295 | electrical power outlet |
| 310 | an outer surface |
| 320 | a first container |
| 330 | a first communication path |
| 340 | a first orifice |
| 350 | a flow control device |
| 360 | a second container |

TABLE 1-continued

TABLE OF REFERENCE NUMBERS

| Number | Term |
|---|---|
| 370 | a second communication path |
| 380 | a second orifice |
| 390 | a pump |
| 400 | fluid |
| 410 | a heater |

DETAILED DESCRIPTION

The inventive concept will now be taught using various exemplary examples. Although the examples are described in detail, it will be appreciated that the inventive concept is not limited to just these examples, but has a scope that is significantly broader.

Figure 1:
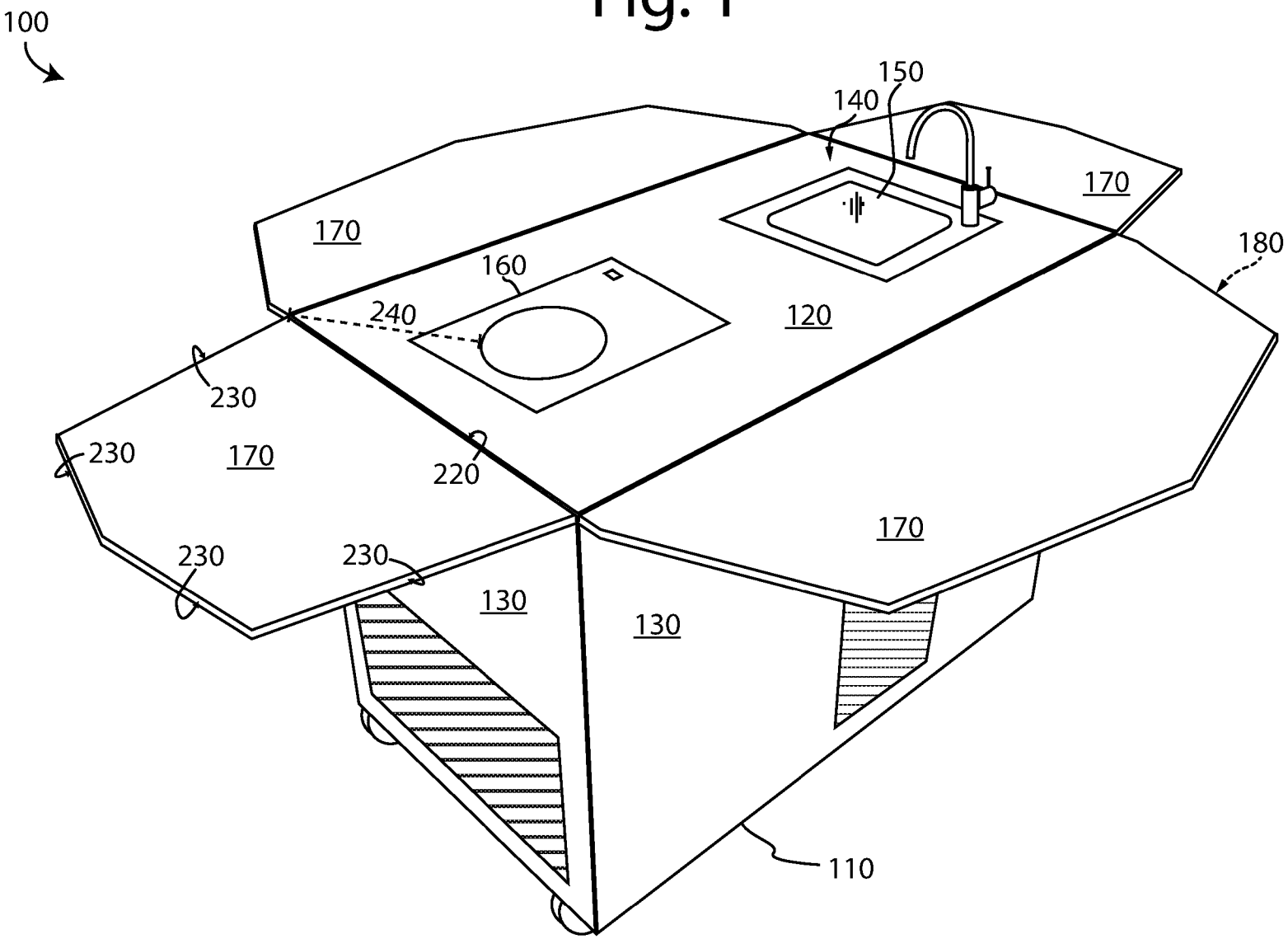
FIG. 1 is a perspective view of an example.

Turning to FIG. 1, an example of the apparatus is shown generally at 100. The apparatus includes a wheeled cabinet 110 with a cabinet top 120 and four cabinet sides 130. The cabinet top 120 has a surface 140 with an opening accommodating a basin 150, and a heating unit 160. The heating unit is, in one example, a commercial drop in warmer induction burner such as the Vollrath 5950145 cabinet top 120 Volt Mirage model. Other equipment is substituted in other examples of the apparatus, as the heating unit 160, within the scope and spirit of the appended claims. At each of the four cabinet sides 130 there is an extension 170, and four extensions 170 are provided. In FIG. 1, the four extensions 170 are in a first position 180.

Figure 2:
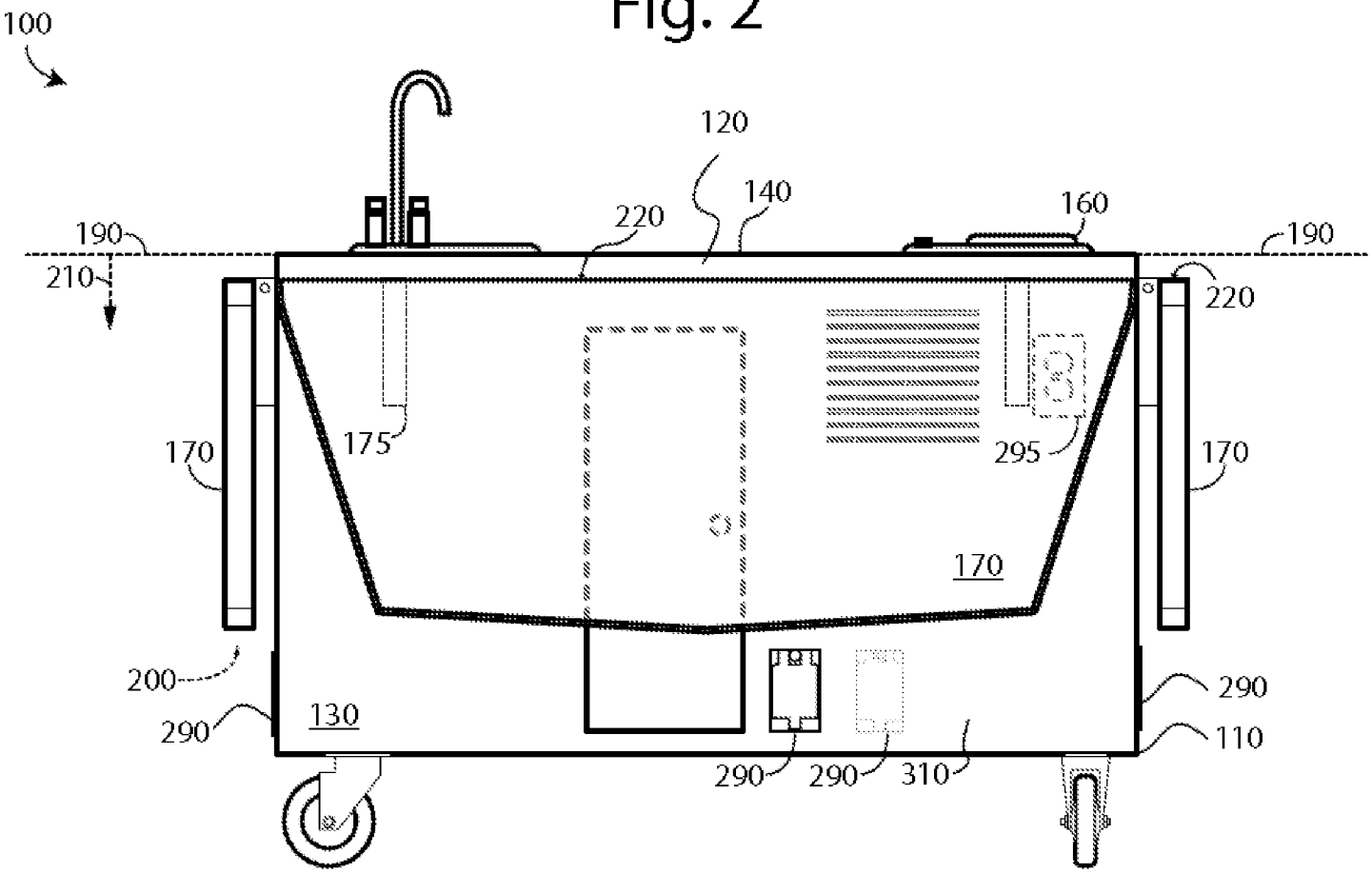
FIG. 2 is a side view of an example.

Focusing on the leftmost of the four extensions 170, the edge nearest the wheeled cabinet 110 is a proximal edge 220. Proximal edge 220 is also illustrated in FIG. 2. The remainder of the edges not adjacent the wheeled cabinet 110 constitute one or more distal edges 230. The four extensions 170 accommodate a number of students by virtue of their particular shapes. The ones of the four extensions 170 attached to the sides of the wheeled cabinet 110 accommodate four students comfortably, while the ones of the four extensions 170 attached to the ends of the wheeled cabinet 110 accommodate at least two students comfortably.

Note that the four extensions 170 serve to move the students away from the surface 140 so that no student can come closer than a predetermined distance 240 from the heating unit 160.

The water dispensing fixture shown in FIG. 1 has a single handle. In one example, only cold water is dispensed, and the flow of the cold water can be shut off using the single handle. In an alternative example, hot and cold water are both dispensed, and both are controlled through the type of well-known faucet shown in FIG. 1.

Turning to FIG. 2, there is shown another example of the apparatus 100. FIG. 2 shows the wheels of the wheeled cabinet 110 in greater detail, but this type of wheel is shown as an example and the detail is not provided for the sake of limitation. The number and location of the wheels, as well as their manner of being fixed to the wheeled cabinet 110, can vary in numerous ways and still be consistent with the appended claims.

In FIG. 2, the four extensions 170 are shown folded down in a second position 200. The first position 180 differs from the second position 200. In the first position 180 (FIG. 1), the four extensions 170 extend laterally away from the four cabinet sides 130 in a plane 190 of the surface 140. In the second position 200 (FIG. 2), the four extensions 170 extend in a direction 210 perpendicular to the plane 190 of the surface 140 of the cabinet top 120.

The hardware that supports the four extensions 170 when in the first position 180 is reconfigurable extension support hardware 175. The reconfigurable extension support hardware 175 is, in an example, the model S-151/12E folding shelf brackets available from SELBY FURNITURE HARDWARE COMPANY, or similar. Numerous alternative implementations of reconfigurable extension support hardware 175 are available and within the scope and spirit of the appended claims.

When the four extensions 170 are in the second position 200, the apparatus 100 can be wheeled through classroom doorways. Once inside the classroom, the apparatus 100 can be reconfigured so that the four extensions 170 are in the first position 180, thereby providing an excellent hands-on food preparation surface which separates the school-age students from the potential dangers of the heating unit 160 or other cooking implements that are present upon surface 140 from time to time such as knives, blenders, and the like. The school-age students are separated from the heating unit by at least a predetermined distance by virtue of the configuration of the four extensions 170 in the first position 180.

FIG. 2 also illustrates electrical power inlet receptacle 290 which is mounted at least in part on an outer surface 310 of the illustrated one of the four cabinet sides 130 of the wheeled cabinet 110. The electrical power inlet receptacle 290 is implemented in one example as the LEVITON 5278-FWP which is a straight blade power inlet suitable for industrial indoor and outdoor applications. A straight blade power inlet permits the use of three-prong grounded extension cords to connect the wheeled cabinet 110 with the type of outlet most commonly found in classrooms in public school. The use of the above-identified receptacle is an example only, and in other examples receptacles of other types and configurations are used.

The electrical power inlet receptacle 290 is electrically connected to various internal wiring and circuitry (not illustrated) and provides power to one or more electrical outlets mounted on the outer surface 310 of the wheeled cabinet 110 (see, e.g., the electrical outlet 295). The number and location of the one or more electrical outlets vary in other examples of the apparatus, within the scope and spirit of the appended claims. Furthermore, in examples, one or more electrical outlets are provided in the interior of the wheeled cabinet 110 so as to provide convenient electrical power to internal equipment such as heating unit 160, oven 280 (shown in FIG. 6 and described further below), pump 390 (shown in FIG. 7 and described further below), and heater 410 (shown in FIG. 7 and described further below). In other examples, internal equipment is electrically connected to the electrical power inlet receptacle 290 by connections that do not require any electrical outlet 295. As used herein, two elements are "electrically connected" when there is a path by which electricity can flow between the two elements, regardless of the presence of intermediate components such as fuses, connectors, switches, or other equipment.

In an example, more than one electrical power inlet receptacle 290 is provided so that power can be obtained, in the classroom or other facility, from different electrical circuits of the school/building. In an example, certain of the internal equipment is powered from power supplied through a first electrical power inlet receptacle 290, and other internal equipment is powered from power supplied through a second electrical power inlet receptacle 290. In an example, an electrical power inlet receptacle 290 is provided on each of the four cabinet sides 130 so that connection to a source of electricity can be accomplished without requiring the extension cord to be routed around the wheeled cabinet 110. The routing of an extension cord around the wheeled cabinet 110 is to be avoided because of the potential for the cord to cause school-age students to experience discomfort or even trip.

In FIG. 2, the water dispensing fixture is of the type in which separate controls are provided for hot and cold, respectively. FIG. 2 also illustrates that the wheeled cabinet 110, in various examples, includes access doors and vents, and such features are within the scope and spirit of the appended claims.

Figure 3:
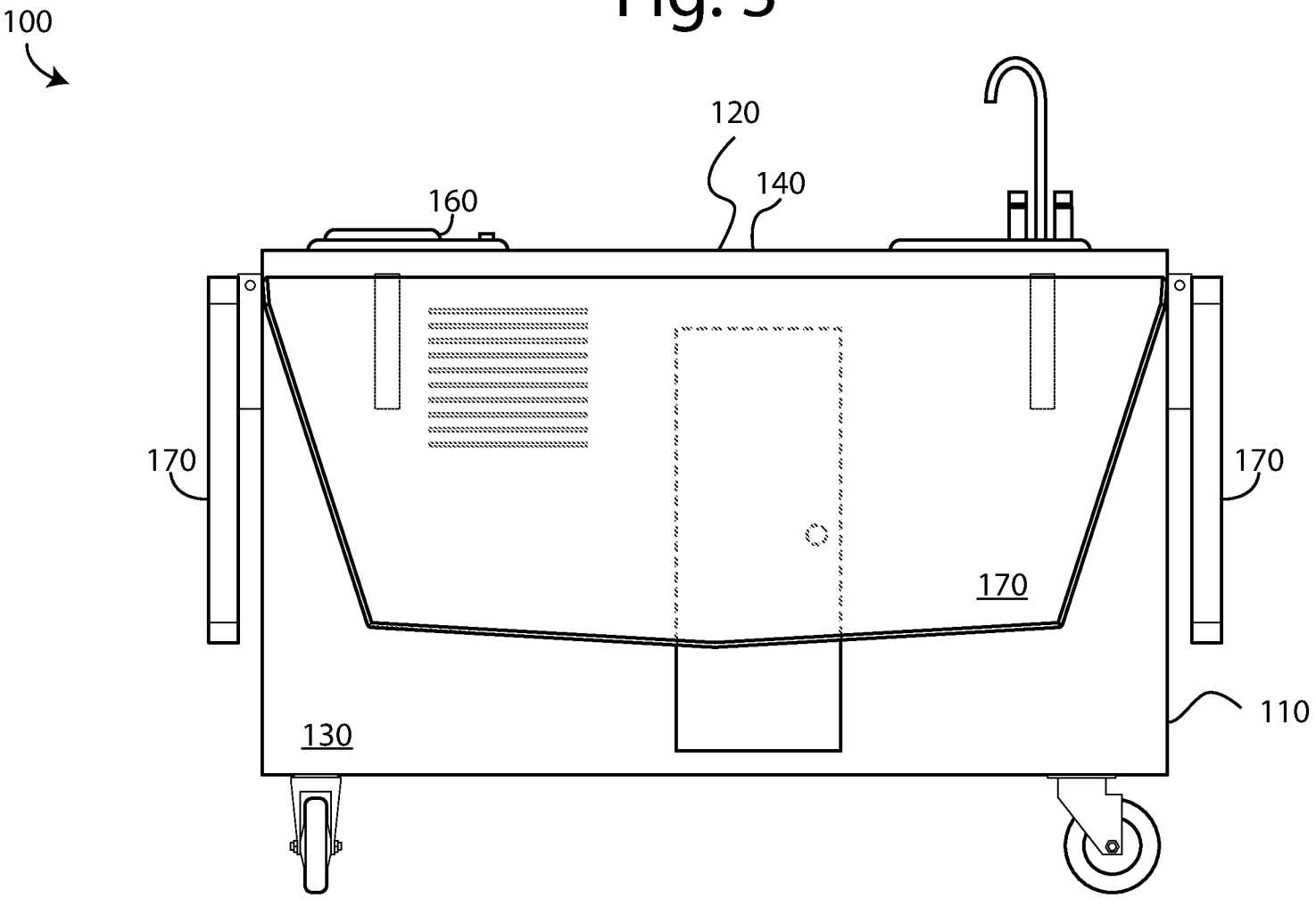
FIG. 3 is a view of a different side of the example depicted in FIG. 2.

FIG. 3 shows the opposite side of the wheeled cabinet 110. In an example, two of the four cabinet sides 130 have access doors so that interior equipment can be reached. In an example, any doors on the four cabinet sides 130 are lockable so that school-age children can be kept away from the potential danger posed by interior equipment and electrical connections.

Figure 4:
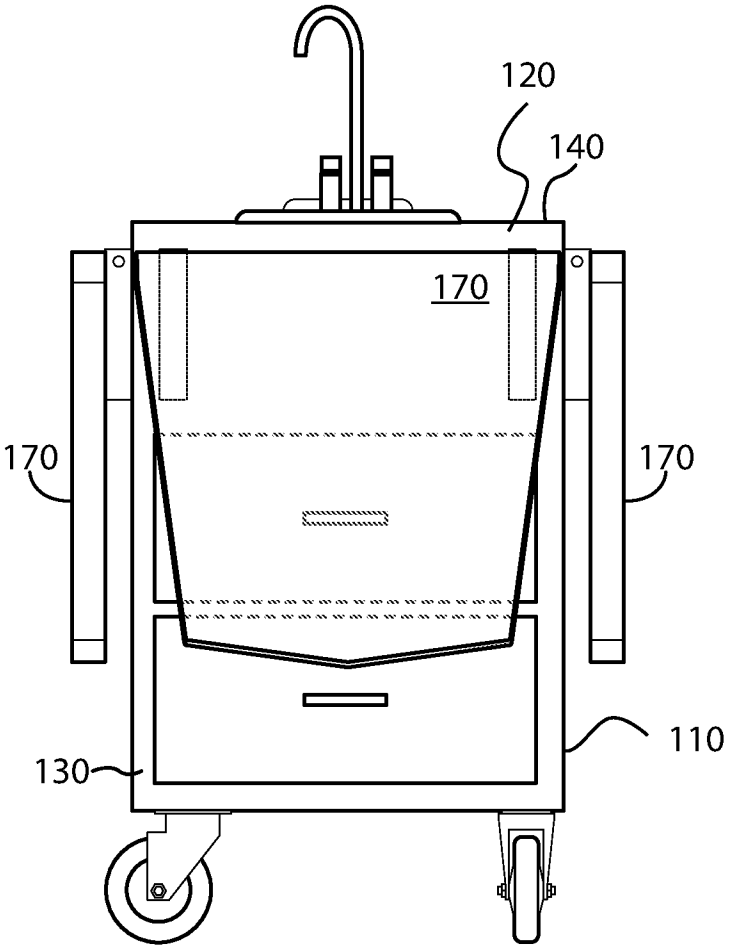
FIG. 4 is an end view of an example.

FIG. 4 shows an end of the wheeled cabinet 110 nearest the basin 150. In an example, the one of the four cabinet sides 130 has equipment storage drawers. In an example, the storage drawers are lockable. In examples, additional storage drawers or compartments are provided in other locations.

Figure 5:
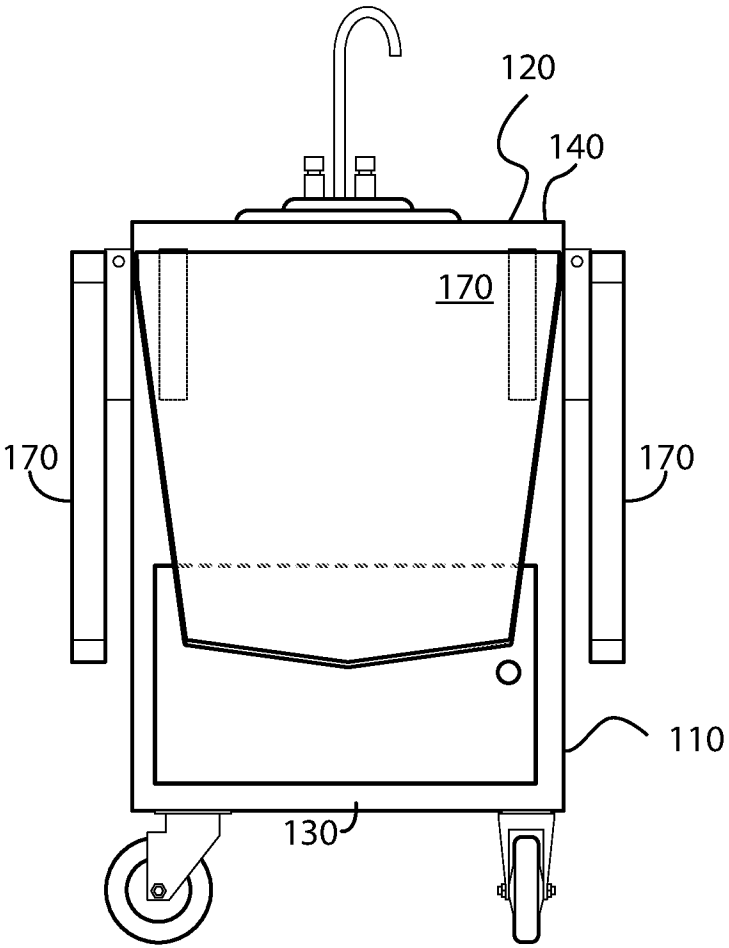
FIG. 5 is a view of a different end of the example depicted in FIG. 4.

FIG. 5 shows an end of the wheeled cabinet 110 nearest the heating unit 160. In an example, a compartment with a lockable door is provided.

Figure 6:
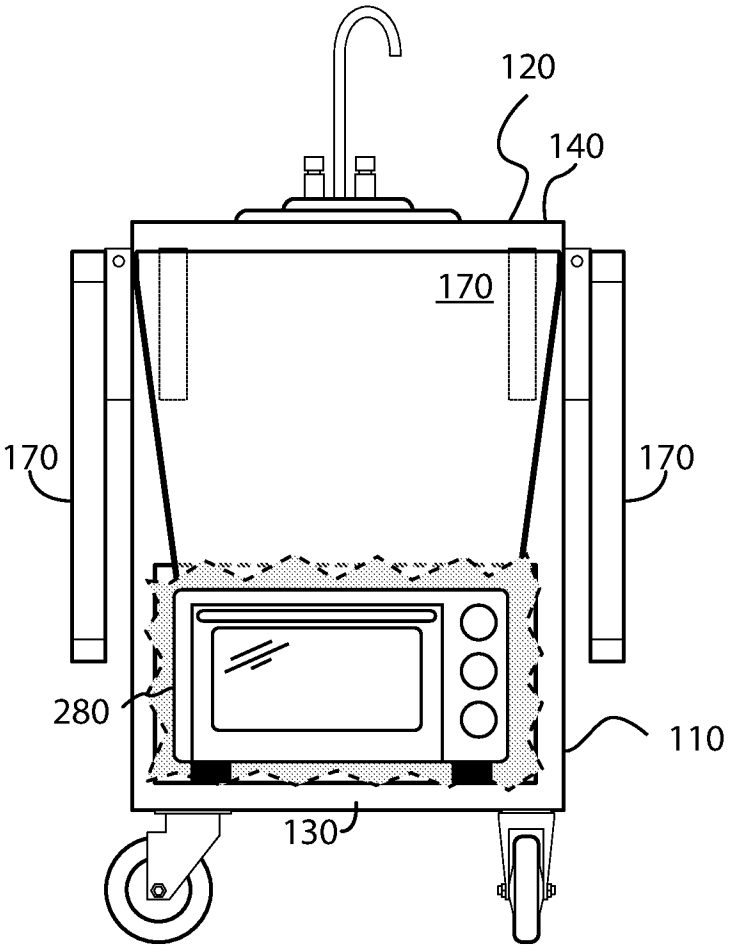
FIG. 6 shows the view of FIG. 5, exploded to reveal details of the interior.

FIG. 6 shows, via a cutaway view, an oven 280 within the compartment. The oven in some examples is a portable oven available from companies such as WARING, OSTER, or others. For example, the oven is an OSTER countertop oven model TSSTTVXXLL. In an example, the oven 280 is a convection oven. Other ovens are used within the scope and spirit of the appended claims. In an example, the oven 280 plugs into an electrical outlet 295 mounted at the rear of the compartment in which the oven 280 is kept. In an example, the oven 280 receives power through an electrical connection with the electrical power inlet receptacle 290.

Figure 7:
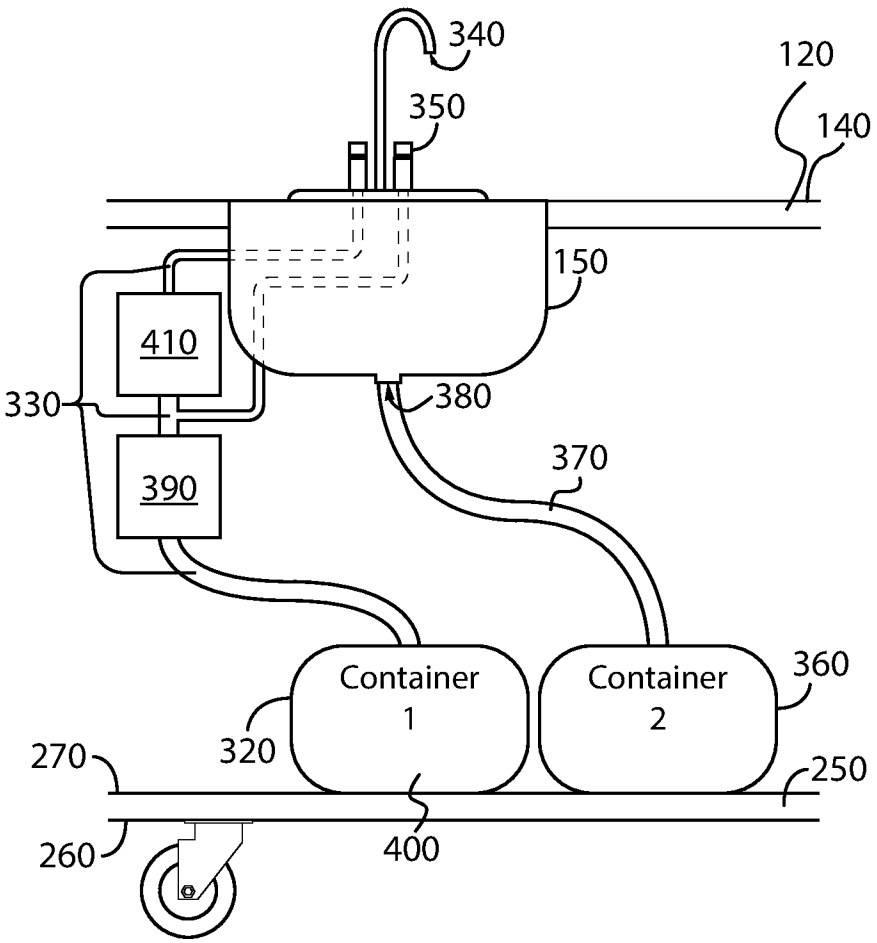
FIG. 7 shows a partial interior view of an example.

FIG. 7 shows, in simplified schematic form, an example in which hot and cold water are provided into the basin 150. In FIG. 7, a base bottom 250 of the wheeled cabinet 110 has an exterior face 260 exposed to the outside of the wheeled cabinet 110 and an interior face 270 opposite the exterior face 260. The area within wheeled cabinet 110 between the surface 140 of the cabinet top 120 and the interior face 270 defines the interior of the wheeled cabinet 110.

In FIG. 7, a first container 320 is within wheeled cabinet 110 and is suitable to be filled with potable water as a fluid 400. To that end, first container 320 is, in an example, removably connectable to a set of one or more water pipes, connections, and fixtures. Such a set of pipes, connections, and fixtures is referred to here as a first communication path 330. The first communication path 330 communicates between first container 320 and a first orifice 340. The first orifice 340 is the opening from which the fluid 400 emerges from the water faucet. Typically, the first orifice 340 is located above the surface 140 of the cabinet top 120.

In an example, a different type of fixture is used, such as a flexible hose or the like, in which case the first orifice 340 is the opening of the hose. Therefore, the first communication path 330 communicates fluid 400 between the first container 320 and the first orifice 340. In an example, the first container 320 is not removably connectable to the first communication path 330, but has an opening through which fluid 400 is introduced.

In an example, one or more faucet handles are provided as a flow control device 350. The flow control device 350 controls the communication of the fluid 400 to the first orifice 340.

In an example, a pump 390 urges the fluid 400 toward the first orifice 340. In an example, the pump 390 is electrically connected with the electrical power inlet receptacle 290. In an example, the pump 390 is a hand pump. One example of a suitable pump 390 is a SHURFLO Revolution Series water pump model 4008-171-E65 or the like.

In an example, the first communication path 330 includes a tee connection so that some of the fluid 400 communicates through a heater 410. One example of a heater 410 suitable for use is a CHRONOMITE SR 15-L SR series instant flow water heater or the like. In other words, the heater 410 is operable to heat fluid 400 from the first container 320. In examples, the location and type of heater 410 is varied. For example, in an example, first container 320 is divided into two subcompartments, and heater 410 is located inside one of the two subcompartments. Other arrangements are possible and within the scope and spirit of the appended claims.

In FIG. 7, fluid 400 (as dirty water) exits basin 150 via a second orifice 380. The drain of the basin 150 is an example of a second orifice 380. Typically, the second orifice 380 is located at the bottom of the basin 150, at a level between the cabinet top 120 and the interior face 270 of the base bottom 250. By gravity, the fluid 400 is conveyed to a second container 360 via a second communication path 370.

In an example, the apparatus 100 including wheeled cabinet 110 is part of a kit that includes materials useful in delivering food preparation instructions. In an example, the kit also includes: 10 each of cutting boards, safety knives, peelers, whisks & small bowls; 2 mixing bowls; 2 mixing spoons; 2 Spatulas; 2 baking pans; 2 muffin tins; 2 hot pads; 1 large sauté pan; 1 large & small pot/lid; 1 ladle; 1 tongs; 1 drum grater; 1 set of measuring cups; 1 set of measuring spoons; 1 liquid measure; 1 Thermometer; 1 Can Opener; 1 pitcher; 1 Colander; 1 Storage bin; 1 fire extinguisher; 2 extension cords; a blender; and educational curriculum materials.

Many variations to the above-identified examples are possible without departing from the scope and spirit of the invention. Possible variations have been presented throughout the foregoing discussion.

Although the examples of the apparatus described above are useful in delivering food preparation instruction to school-aged children, the examples of the apparatus are also useful in other contexts such as in hospitals, universities, community centers or the like. Such an apparatus is also useful in an outdoor context for teaching camp cooking, as an example, or teaching the preparation of food gathered directly from nature. In such an outdoor context, the power is advantageously provided by sources other than an electrical extension cord. Modifying the examples herein to accept power from batteries, generators, liquid propane gas, etc., is well within the skill of those familiar with this field.

Combinations and subcombinations of the various examples described above will occur to those familiar with this field, without departing from the scope and spirit of the inventive concept.

There is claimed:

1. An apparatus, comprising:

a wheeled cabinet with a cabinet top and four cabinet sides;

the cabinet top having a surface with an opening accommodating a basin, and having a heating unit, the heating unit being fixed to the surface of the cabinet top, the heating unit being adapted to heat using induction;

four extensions disposed at the four cabinet sides, configurable in a first position to extend laterally away from the four cabinet sides, in a plane of the surface of the cabinet top;

the four extensions being further configurable to a second position, to extend in a direction perpendicular to the plane of the surface of the cabinet top;

the four extensions each having a proximal edge adjacent the cabinet top and at least four distal edges not adjacent the four cabinet sides when the four extensions are in the first position; and the at least four distal edges of each of the four extensions being at least a predetermined distance from the heating unit, wherein a first of the four cabinet sides comprise a first power inlet receptacle, wherein a second of the four cabinet sides comprises a second power inlet receptacle, and wherein the first power inlet receptacle and the second power inlet receptacle are each configured to electrically connect the heating unit to a power source.

2. The apparatus as in claim 1, further comprising the wheeled cabinet having a base bottom with an exterior face exposed to the outside of the wheeled cabinet and an interior face opposite the exterior face.

3. The apparatus as in claim 2, further comprising an oven disposed between the cabinet top and the interior face of the base bottom.

4. The apparatus as in claim 3, wherein at least one of the first power inlet receptacle and the second power inlet receptacle is electrically connected with the oven.

5. The apparatus as in claim 2, further comprising:

a first container within the wheeled cabinet;

a first communication path communicating between the first container and a first orifice disposed above the cabinet top; and a flow control device controlling the communication to the first orifice.

6. The apparatus as in claim 5, further comprising:

a second container within the wheeled cabinet; and a second communication path communicating between the second container and a second orifice, the second orifice disposed between the cabinet top and the interior face of the base bottom.

7. The apparatus as in claim 5, further comprising a pump operable in the first communication path to urge fluid toward the first orifice.

8. The apparatus as in claim 7, wherein at least one of the first power inlet receptacle and the second power inlet receptacle is electrically connected with the pump.

9. The apparatus as in claim 7, further comprising a heater operable to heat fluid from the first container.

10. The apparatus as in claim 5, wherein the first container is connected to two sub compartments which are, along the first communication path, between the first container and the basin.

11. The apparatus as in claim 10, further comprising a heater located within one of the two sub compartments.

12. The apparatus as in claim 1, wherein each of the at least four distal edges is a straight shaped edge.

13. The apparatus as in claim 1, wherein a third of the four cabinet sides comprises a third power inlet receptacle, wherein a fourth of the four cabinet sides comprises a fourth power inlet receptacle, and wherein the third power inlet receptacle and the fourth power inlet receptacle are each configured to electrically connect the apparatus to the power source.

14. The apparatus as in claim 13, wherein each of the first power inlet receptacle, the second power inlet receptacle, the third power inlet receptacle and the fourth power inlet receptacle are straight blade power inlets configured to receive a three-prong grounded extension cord connection.

15. The apparatus as in claim 1, further comprising a lockable access door on at least one of the four cabinet sides.

16. An apparatus, comprising:

a wheeled cabinet with a cabinet top and four cabinet sides;

the cabinet top having a surface with an opening accommodating a basin, and having a heating unit;

four extensions disposed at the four cabinet sides, configurable in a first position to extend laterally away from the four cabinet sides, in a plane of the surface of the cabinet top;

the four extensions each having a proximal edge adjacent the cabinet top and at least four distal edges not adjacent the four cabinet sides when the four extensions are in the first position;

the wheeled cabinet having a base bottom with an exterior face exposed to the outside of the wheeled cabinet and an interior face opposite the exterior face; and a convection oven disposed between the cabinet top and the interior face of the base bottom, wherein a first of the four cabinet sides comprises a first power inlet receptacle, wherein a second of the four cabinet sides comprises a second power inlet receptacle, and wherein the first power inlet receptacle and the second power inlet receptacle are each configured to electrically connect the heating unit to a power source.

17. The apparatus as in claim 16, further comprising the four extensions being further configurable to a second position, to extend in a direction perpendicular to the plane of the surface of the cabinet top.

18. The apparatus as in claim 16, further comprising the heating unit being fixed to the surface of the cabinet top.

19. The apparatus as in claim 18, further comprising:

the at least four distal edges of the four extensions being at least a predetermined distance from the heating unit.

20. The apparatus as in claim 16, wherein at least one of the first power inlet receptacle and the second power inlet receptacle is electrically connected with the convection oven.

21. The apparatus as in claim 16, further comprising:

a first container within the wheeled cabinet;

a first communication path communicating between the first container and a first orifice disposed above the cabinet top; and a flow control device controlling the communication to the first orifice.

22. The apparatus as in claim 21, further comprising:

a second container within the wheeled cabinet; and a second communication path communicating between the second container and a second orifice, the second orifice disposed between the cabinet top and the interior face of the base bottom.

23. The apparatus as in claim 21, further comprising a pump operable in the first communication path to urge fluid toward the first orifice.

24. The apparatus as in claim 23, wherein at least one of the first power inlet receptacle and second power inlet receptacle is electrically connected with the pump.

25. The apparatus as in claim 21, further comprising a heater operable to heat fluid from the first container.

* * * * *